US011779851B2

(12) United States Patent
Vance et al.

(10) Patent No.: US 11,779,851 B2
(45) Date of Patent: Oct. 10, 2023

(54) WATER AMUSEMENT RIDE MOTION GOVERNOR

(71) Applicant: Universal City Studios LLC, Universal City, CA (US)

(72) Inventors: Eric Vance, Ocoee, FL (US); Christine Sorrentino, Orlando, FL (US); Ryan Dale Walton, Orlando, FL (US)

(73) Assignee: Universal City Studios LLC, Universal City, CA (US)

( * ) Notice: Subject to any disclaimer, the term of this patent is extended or adjusted under 35 U.S.C. 154(b) by 119 days.

(21) Appl. No.: 17/464,372

(22) Filed: Sep. 1, 2021

(65) Prior Publication Data

US 2021/0394075 A1 Dec. 23, 2021

Related U.S. Application Data

(62) Division of application No. 16/688,779, filed on Nov. 19, 2019, now Pat. No. 11,130,068.

(60) Provisional application No. 62/769,996, filed on Nov. 20, 2018.

(51) Int. Cl.
*A63G 21/18* (2006.01)
*A63G 31/00* (2006.01)

(52) U.S. Cl.
CPC ..... *A63G 21/18* (2013.01); *A63G 31/007* (2013.01)

(58) Field of Classification Search
CPC ..... A63G 21/18; A63G 31/007
See application file for complete search history.

(56) References Cited

U.S. PATENT DOCUMENTS

| | | | |
|---|---|---|---|
| 3,003,430 | A | 10/1961 | Hamel |
| 3,930,450 | A | 1/1976 | Symons |
| 4,149,469 | A | 4/1979 | Bigler |
| 5,989,126 | A | 11/1999 | Kilbert et al. |
| 7,371,183 | B2 | 5/2008 | Henry et al. |
| 8,079,916 | B2 | 12/2011 | Henry |

(Continued)

FOREIGN PATENT DOCUMENTS

| | | | |
|---|---|---|---|
| CN | 104797312 | A | 7/2015 |
| CN | 106999779 | A | 8/2017 |

OTHER PUBLICATIONS

CN Office Action for Chinese Application No. 201980076555.5 dated Dec. 20, 2022.

(Continued)

*Primary Examiner* — Michael D Dennis
(74) *Attorney, Agent, or Firm* — Fletcher Yoder P.C.

(57) ABSTRACT

A ride system includes a flume providing a flow path of a water ride and configured to accommodate a buoyant ride vehicle. The ride system also includes a support element extending into the flow path and at least partially submerged within the flow path. Moreover, the ride system includes a driving mechanism configured to actuate the support element such that the support element moves relative to the flow path in response to a control signal. The support element is configured to contact the buoyant ride vehicle to control movement of the buoyant ride vehicle along the flow path while the support element is being actuated. Further, the ride system includes a controller configured to generate the control signal based at least in part on a location of the buoyant ride vehicle in the flow path and a timer controlling activation of a show element.

20 Claims, 8 Drawing Sheets

(56) References Cited

U.S. PATENT DOCUMENTS

| | | | | |
|---|---|---|---|---|
| 8,091,483 | B1 * | 1/2012 | Sumner | A63G 3/00 104/73 |
| 2006/0052171 | A1 | 3/2006 | Henry et al. | |
| 2006/0135274 | A1 * | 6/2006 | Henry | A63G 3/02 472/128 |
| 2006/0142090 | A1 | 6/2006 | Henry | |
| 2006/0219124 | A1 | 10/2006 | Jordan | |
| 2007/0049385 | A1 | 3/2007 | Henry et al. | |
| 2007/0049386 | A1 | 3/2007 | Henry | |
| 2010/0160054 | A1 | 6/2010 | Henry | |
| 2011/0028227 | A1 | 2/2011 | Dubois et al. | |
| 2011/0108396 | A1 | 5/2011 | Costanzo et al. | |
| 2012/0291657 | A1 | 11/2012 | Nemeth | |
| 2013/0244801 | A1 | 9/2013 | Frolov | |
| 2014/0277849 | A1 * | 9/2014 | Grant | A63G 31/00 701/2 |
| 2015/0336012 | A1 * | 11/2015 | Maycock | A63J 25/00 701/2 |
| 2015/0367241 | A1 | 12/2015 | Fisher | |
| 2017/0113149 | A1 | 4/2017 | Schwartz | |
| 2019/0262728 | A1 * | 8/2019 | Laffin | A63G 3/00 |
| 2020/0108324 | A1 | 4/2020 | Bloomfield et al. | |

OTHER PUBLICATIONS

PCT/IB2019/060006 Search Report and Written Opinion dated Mar. 27, 2020.

IN Office Action for Indian Application No. 202117022821 dated Nov. 23, 2022.

* cited by examiner

WATER AMUSEMENT RIDE MOTION GOVERNOR

CROSS-REFERENCE TO RELATED APPLICATIONS

The present application is a divisional of U.S. application Ser. No. 16/688,779, entitled "Water Amusement Ride Motion Governor," which claims priority to and the benefit of U.S. Provisional Application No. 62/769,996, entitled "Water Amusement Ride Motion Governor" and filed Nov. 20, 2018, the disclosures of which are incorporated herein by reference for all purposes.

FIELD OF DISCLOSURE

The present disclosure relates generally to the field of amusement parks. Specifically, embodiments of the present disclosure relate to techniques to govern motion of a ride vehicle of an attraction.

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Various forms of amusement rides have been used for many years in amusement or theme parks. These amusement rides include water-based rides. Certain water-based rides include show elements, e.g., special effects or animatronic set pieces, at particular locations along a flow path. Generally, water-based rides attempt to align a start time of a show element with an arrival of a ride vehicle to the show element. Some water-based rides adjust a start time of the show element to ensure that the show element is initiated as the ride vehicle arrives. However, adjusting the start time of the show element may lead to inconsistent ride durations and, consequently, inconsistent ride queues. Other water-based rides attempt to adjust the speed of the ride vehicle, such that the ride vehicle arrives to the show element at a set start time for the show element. However, adjusting the speed and/or location of a water-based ride vehicle is complex, particular for water vehicles that are influenced by water current or gravity effects.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In accordance with one embodiment, a ride system is provided. The ride system includes a flume providing a flow path of a water ride and configured to accommodate a buoyant ride vehicle. The ride system also includes at least one support element extending into the flow path and at least partially submerged within the flow path. Moreover, the ride system includes a driving mechanism configured to actuate the at least one support element such that the at least one support element moves relative to the flow path in response to a control signal. The at least one support element is configured to contact the buoyant ride vehicle to control movement of the buoyant ride vehicle along the flow path while the at least one support element is being actuated. Further, the ride system includes a controller configured to generate the control signal based at least in part on a location of the buoyant ride vehicle in the flow path and a timer controlling activation of a show element, wherein the show element is located along the flow path.

In accordance with another embodiment, a ride system is provided. The ride system includes a motion governor. The motion governor includes a conveyor configured to rotate along a track disposed within a flow path of water ride. The motion governor also includes a driving mechanism configured to control rotation of the conveyor in response to a control signal. Further, the motion governor includes at least one support element coupled to the conveyor. The at least one support element is configured to contact a ride vehicle to control movement of the ride vehicle along the flow path. The ride system also includes a controller configured to receive a location signal indicative of a location of the ride vehicle along the flow path, estimate an arrival time to a show element based on the location, determine that the estimated arrival time deviates from a scheduled show element start time, and generate the control signal upon determining that the estimated arrival time deviates from the scheduled show element start time.

In accordance with another embodiment, a method to govern motion of the ride vehicle along a flow path of the water-based ride attraction is provided. The method includes the step of providing a flow path configured to be traversed by a buoyant ride vehicle. The method also includes the step of receiving a control signal comprising instructions to actuate a driving mechanism based at least in part on a location of the buoyant ride vehicle in the flow path and a timer of a show element. The method also includes the step of actuating the driving mechanism in response to the control signal. At least one support element is coupled to the driving mechanism and configured to move along the flow path as a result of actuating the driving mechanism. The method also includes the step of contacting the ride vehicle with the at least one support element to change a speed of the ride vehicle along the flow path.

In accordance with another embodiment, a ride system is provided. The ride system includes a controller configured to determine a location of a ride vehicle with respect to a show element. The controller is also configured to determine an estimated arrival of the buoyant ride vehicle at the show element based at least in part on the location. The controller is also configured to determine that the estimated arrival time deviates from a scheduled show element start time. The controller is also configured to generate a control signal comprising instructions to rotate a conveyor upon determining that the estimated arrival time deviates from the scheduled show element start time. The at least one support element is coupled to the conveyor and is configured to contact the buoyant ride vehicle to control movement of the ride vehicle along a flow path based on rotation of the conveyor. The controller is also configured to output the control signal to a motion governor coupled to the conveyor.

DRAWINGS

Various aspects of this disclosure may be better understood upon reading the following detailed description and upon reference to the drawings in which.

DETAILED DESCRIPTION

Figure 1:
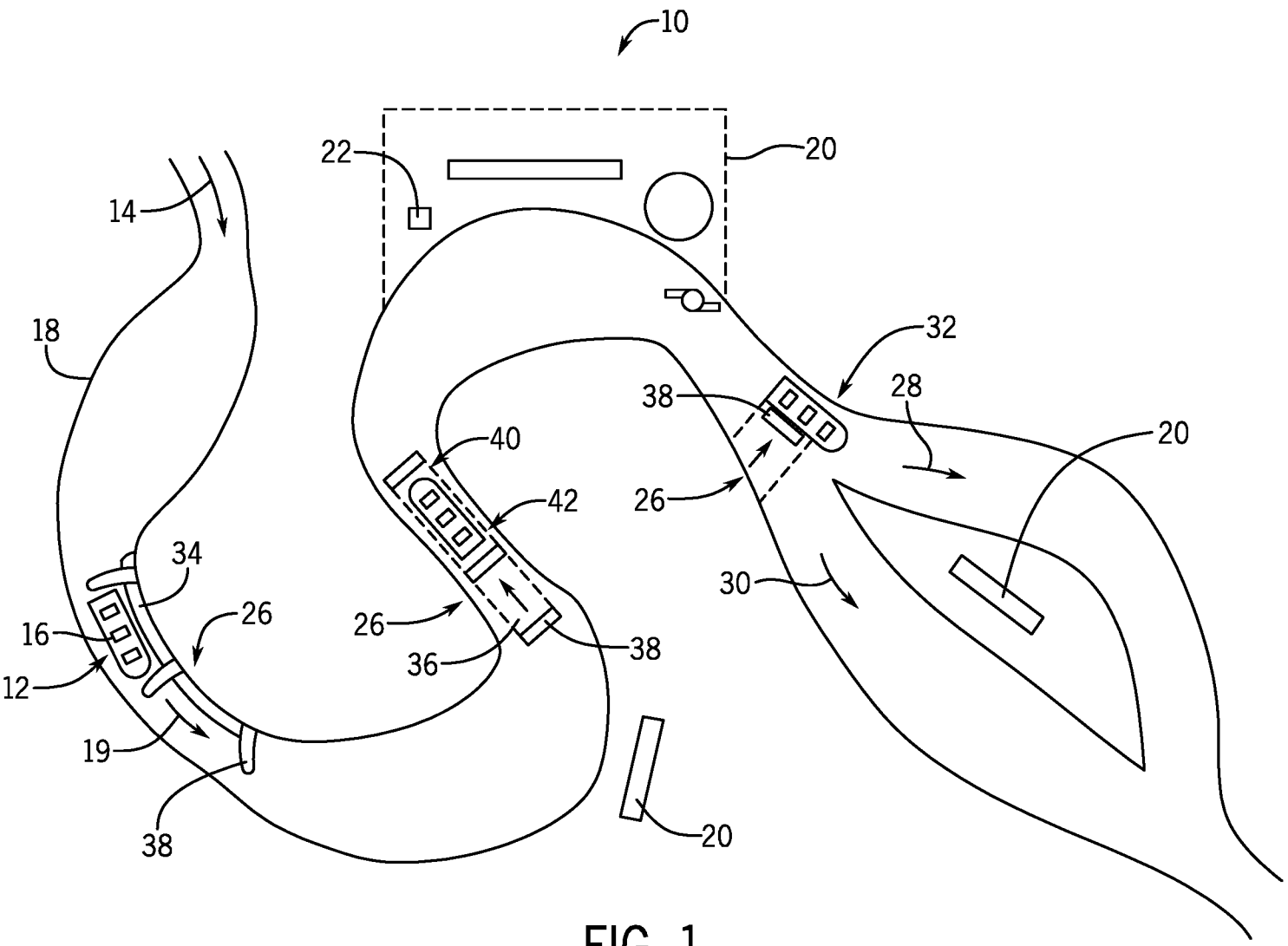
FIG. 1 is a schematic view of a water-based ride attraction, in accordance with present techniques.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Theme park or amusement park attractions have become increasingly popular, and various amusement park attractions have been created to provide passengers with unique motion and visual experiences. These theme park or amusement park attractions include water-based attractions. Water-based attractions may have at least one ride vehicle configured to carry passengers along a flow path. To improve the immersive experience, the attraction may also have one or more show elements, e.g., special effects, movable set pieces, distributed along the ride or flow path of the ride vehicle. However, in contrast to track-based vehicles that move along a track at relatively predictable speeds based on the motor control signals, buoyant water-ride vehicles are subject to variable forces such as water current, gravity, water levels, passenger weight. Accordingly, buoyant water ride vehicles operate with wider time slippage over the course of the ride and a greater variability in speed. Thus, for certain types of water rides, it is difficult to predict or control an arrival time of each ride vehicle to the locations associated with each show piece to align initiation of the show piece motion and/or effect with the arrival of the ride vehicle. In certain cases, to ensure that a vehicle arrives to a show element at a start time of the show element, the water-based attraction may dynamically adjust the start time of the show element. However, such adjustment permits widely varying ride times, which may in turn cause excess wait times for the ride. Alternatively, certain rides may include features that adjust the speed of the ride vehicle along the flow path using a track or other locking system that couples the ride vehicle to the flume to control advancement of the ride vehicle. However, such tracks or other locking systems limit freedom of motion of the ride vehicle in a manner that reduces a floating or buoyant effect experienced by a guest in the ride vehicle. Thus, in accordance with certain embodiments of this disclosure, a system or method for adjusting the speed of the ride vehicle, e.g., to achieve alignment with one or more show elements, while maintaining the floating or buoyant effect experienced by a guest in the ride vehicle is provided.

FIG. 1 is a schematic view of a water-based attraction 10 with a ride vehicle 12 traveling along a flow path 14 of the water-based attraction during a ride cycle. The ride vehicle 12 includes at least one ride seat 16 for a passenger of the ride vehicle 12. During the ride cycle, the passenger may sit in the at least one ride seat as the ride vehicle 12 floats along the flow path 14. The ride vehicle 12 floats along the flow path 14 within a flume 18 (i.e., a channel for water). The flow path 14 may be defined by the flume 18. However, in some embodiments, water jets, propellers, or other suitable devices may alter the flow path 14 within the flume 18. In some embodiments, a current of the water or fluid within the flow path 14 propels the ride vehicle 12 along the flow path 14 in a desired direction or axis of travel (e.g. along arrow 19).

In some embodiments, the water-based attraction 10 includes at least one show element 20 located along the flow path 14. The at least one show element 20 may include animatronics, videos, sound effects, light effects, motion effects, water effects, or any other special effect. The at least one show element 20 may have a start time and end time. In some embodiments, a scheduled show element start time of the show element 20 is based at least in part on a show clock 22. Thus, the at least one show element 20 may start at regular or scheduled timed intervals that correspond with estimated arrival of individual ride vehicles 12 at the show element 20. In some embodiments, the show element 20 starts according to pre-scheduled start times. Thus, the ride vehicle 12 may should arrive at the show element 20 at a predetermined time so that the passenger experiences the show element 20 without missing a beginning or end of the show element 20. Starting the show element 20 at regular intervals or according to prescheduled start times may promote ride throughput predictability as compared to a show element 20 having varying start times.

The water-based attraction 10 has one or more motion governors 26 that may at least in part control movement of the ride vehicle 12 along the flow path 14 or along certain portions of the flow path 14. In some embodiments, the motion governor 26 is configured to control motion of the ride vehicle 12 such that the ride vehicle 12 arrives at the show element 20 at the predetermined time or at the scheduled start time of the show element 20 so that the passenger may experience the show element 20 without missing a beginning or end of the effect. In some embodiments, the one or more motion governors 26 may only be configured to control motion of the ride vehicle 12 when the ride vehicle is predicted to arrive before or after the predetermined time or at the scheduled start time of the show element 20. In some embodiments, the show element 20 includes an introduction buffer configured to form an arrival window for the ride vehicle 12. The introduction buffer may include preliminary videos, sound effects, light effects, motion effects, water effects, or any other special effect. For example, the introduction buffer may include a ten second window of music playing prior to the start of the show element 20. In some embodiments, the one or more motion governors 26 are configured to control motion of the ride vehicle 12 such that the ride vehicle 12 arrives at the show element 20 during the arrival window. Further, in some embodiments, the one or more motion governors 26 may only be configured to control motion of the ride vehicle 12 when the ride vehicle 12 is predicted to arrive before or after the arrival window.

In some embodiments, the motion governor 26 operates in conjunction with the show element 20 and is configured to contribute to an attraction effect (e.g., sudden acceleration or deceleration, rocking motions, etc.). Moreover, in some embodiments, the motion governor 26 is configured to direct the ride vehicle 12 to one of a first flow path 28 or second flow path 30 at a divergence 32 in the flow path 14. The motion governor 26 may facilitate desired movement of the ride vehicle 12 along the flume 18.

The motion governor 26 includes a driving mechanism 34. In some embodiments, the driving mechanism 34 drives rotation of a conveyor 36 in response to a control signal. The driving mechanism 34 may operate at varying speeds and torques to drive the conveyor 36. At least one support element 38 may be coupled to the conveyor 36. As the conveyor 36 turns, the support element 38 may contact the ride vehicle 12 to control movement of the ride vehicle 12 along the flow path 14. For example, the support element 38 may contact a downstream or front portion 40 of the ride vehicle 12 to decelerate the ride vehicle 12. In another example, the support element 38 may contact an upstream or rear portion 42 of the ride vehicle 12 to accelerate the ride vehicle 12. In some embodiments, the support element 38 is coupled directly to the driving mechanism 34 or to an adapter coupled to the driving mechanism 34.

The disclosed motion governor 26 may operate to adjust or change a speed, position, or direction of a floating or buoyant ride vehicle 12 that is not directly affixed or coupled to the flume 18 and that floats within the flow path 14. By engaging support elements that reversibly contact the ride vehicle 12 to push the ride vehicle 12, individual ride vehicles 12 may be nudged into position to arrive at various show elements 20 on time. The motion governor or governors 26 may operate on an as-needed basis and may engage in response to individual ride vehicles 12 deviating from a desired speed or path and to nudge such ride vehicles 12 back into position. Accordingly, for a water-based attraction 10 that accommodates multiple ride vehicles 12, either in parallel or in series, the motion governor 26 may only directly engage a subset of the ride vehicles 12 while allowing other ride vehicles 12 to progress without adjustments depending on progression of the ride vehicles 12 along the flow path 14. In this manner, in certain embodiments, the disclosed techniques permit minor position, orientation, and/or speed adjustments that may be relatively unnoticeable to the passengers and while maintaining a buoyant feeling by avoiding locking the ride vehicles 12 onto tracks or tow elements.

Figure 2:
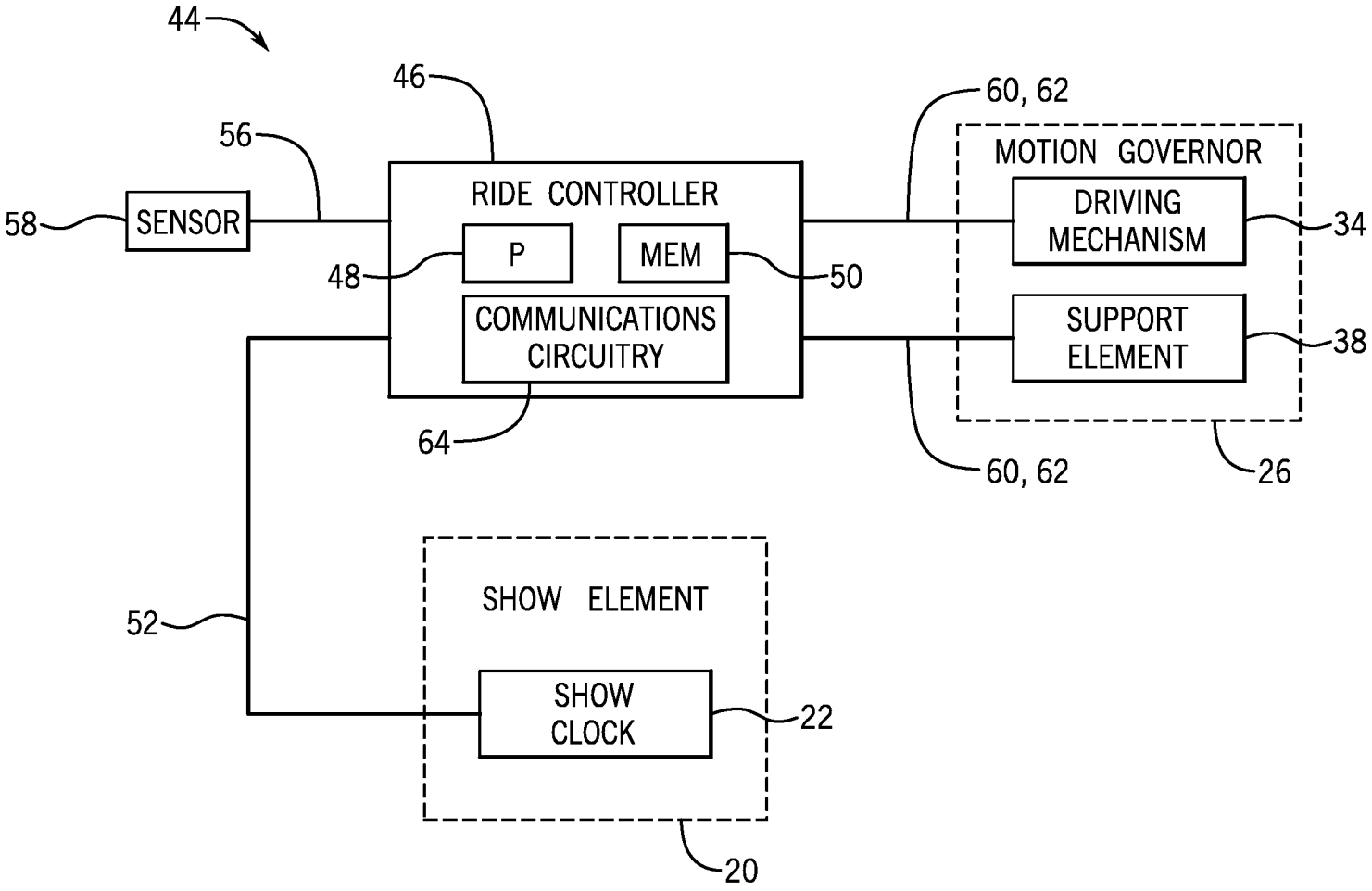
FIG. 2 is a block diagram of a water-based ride attraction control system, in accordance with present techniques.

FIG. 2 is a block diagram of a ride control system 44 for the water-based attraction 10. In some embodiments, the ride control system 44 includes a controller 46 having a processor 48 such as the illustrated microprocessor, and a memory device 50. The controller 46 may also include one or more storage devices and/or other suitable components. Moreover, the processor 48 may include multiple microprocessors, one or more "general-purpose" microprocessors, one or more special-purpose microprocessors, and/or one or more application specific integrated circuits (ASICS), or some combination thereof. For example, the processor 48 may include one or more reduced instruction set (RISC) processors.

The memory device 50 may include a volatile memory, such as random access memory (RAM), and/or a nonvolatile memory, such as read-only memory (ROM). The memory device 50 may store a variety of information and may be used for various purposes. For example, the memory device 50 may store processor-executable instructions (e.g., firmware or software) for the processor 48 to execute. The storage device(s) (e.g., nonvolatile storage) may include ROM, flash memory, a hard drive, or any other suitable optical, magnetic, or solid-state storage medium, or a combination thereof. The storage device(s) may store data (e.g., position data, vehicle geometry data, etc.), instructions (e.g., software or firmware), and any other suitable data.

The controller 46 may be configured to receive a show timer signal 52 from a show clock 22 of the show element 20. As set forth above, the show element 20 may include animatronics, videos, sound effects, or any other special effect. As such, the show element 20 may have a start time and end time associated with each ride vehicle 12 within the water-based attraction 10. The show timer signal 52 may indicate the start time or the end time of the show element 20. In some embodiments, the show timer signal 52 may indicated an amount of time remaining before the show element 20 begins. The show timer signal 52 may indicate any time value from which the controller 46 may determine a start time or end time of the show element 20. While the show clock 22 is shown as being resident on the show element 20, it should be understood that the show clock 22 may be resident on the controller 46. Further, the show clock 22 may be a part of a ride clock that controls all show clocks 22 of the show elements 20 as well as ride vehicle dispatch of the attraction 10 as part of the controller 46.

Moreover, the controller 46 may be configured to receive a location signal 56 indicative of a location of the ride vehicle 12 within the flow path 14 and/or indicative of a distance to an individual show element 20. One or more sensors 58 may be configured to provide the location signal 56 indicative of a position of the ride vehicle 12 in the water-based attraction 10 and output the location signal 56. The location signal 56 may indicate a position of the ride vehicle 12 along the flow path 14 with respect to the motion governor 26. In some embodiments, the location signal 56 may indicate a position of the ride vehicle 12 with respect to the show element 20. However, in another embodiment, the location signal 56 may indicate a position of the ride vehicle 12 along the flow path 14 with respect to a sensor 58. The location signal 56 may indicate a distance between the sensor 58 and the ride vehicle 12. The sensor 58 may be disposed on the motion governor 26 or on the ride vehicle 12. However, in other embodiments, the sensor or sensors 58 is disposed adjacent the flume 18 and proximate at least one support element 38.

In some embodiments, the controller 46 is configured to determine a speed of the ride vehicle 12 based at least in part on the location signal 56, e.g., based on a time elapsed between a first location and a second location of the ride vehicle 12. The sensor 58 may be configured to output multiple location signals. The sensor 58 may output the location signals at regular intervals. In one embodiment, the controller 46 may determine distance from the ride vehicle 12 to the sensor 58 at a first time based at least in part on a first location signal. Further, the controller 46 may determine a distance from the ride vehicle 12 to the sensor 58 at a second time based at least in part on a second location signal. The controller 46 may be configured to determine the speed of the ride vehicle 12 based on a change in distance of the ride vehicle 12 over time as determined from one or more location signals 56.

In some embodiments, the controller 46 is configured to determine an estimated arrival time of the ride vehicle 12 to the motion governor 26, having the at least one support element 38, based at least in part on the location signal 56. The controller 46 may be configured to determine an estimated arrival time to the motion governor 26 based at least in part on the speed of the ride vehicle 12 and a distance between the ride vehicle 12 and the motion governor 26. The controller 46 may be configured to generate a control signal 60 based on the estimated arrival time to the motion governor 26 such that the at least one support element 38 is positioned to receive the ride vehicle 12 at the estimated arrival time at the motion governor 26. The control signal 60 may include instructions to position the at least one support element 38 such that the ride vehicle 12 is received into a slot between a first support element 38 and a second support element 38 at the motion governor 26. The instructions may cause a switch from a retracted or default position outside of the flow path 14 to a deployed or activated position within the flow path 14 and sufficiently protruding into the flow path 14 to contact the ride vehicle 12.

In another embodiment, the controller 46 is configured to determine an estimated arrival time of the ride vehicle 12 to the show element 20 based at least in part on the location signal 56. The controller 46 may be configured to generate the control signal 60 based on the estimated arrival time to the show element 20 and the show timer for the show element 20. The control signal 60 may include instructions to the motion governor 26 to adjust a rate of rotation of the conveyor 36. The control signal 60 may include instructions to slow down the ride vehicle 12 based at least in part on a determination that the ride vehicle 12 will arrive to the show element 20 before a start time of the show element 20. For example, the controller 46 may receive the location signal 56 and determine that the ride vehicle 12 the estimated arrival time for the ride vehicle 12 to arrive to the show element 20 is in 30 seconds. The controller 46 may receive the show timer signal 52 indicating that the start time for the show element 20 is in 34 seconds. Accordingly, the controller 46 will generate a control signal 60 having instructions to slow down the ride vehicle 12 such that a new arrival time for the ride vehicle 12 is aligned with a start time of the show element 20. Moreover, the control signal 60 may include instructions to speed up the ride vehicle 12 based at least in part on a determination that the ride vehicle 12 will arrive to the show element 20 after a start time of the show element 20.

The controller 46 may be configured to output the control signal 60 to the motion governor 26. In some embodiments, the controller 46 is configured to output the control signal 60 to the driving mechanism 34 and/or the at least one support element 38. Further, the controller 46 may be configured to output a disengage signal 62 to the motion governor 26 and/or at least one support element 38 in response to determining that the ride vehicle 12 will arrive at the show element 20 on time. The at least one support element 38 is configured to avoid contact with the ride vehicle 12 in response to receiving the disengage signal 62. In some embodiments, the at least one support element 38 is configured to retract from the flow path 14 to avoid contact with the ride vehicle 12 in response to the disengage signal 62. For example, the controller 46 may determine that the estimated arrival time for the ride vehicle 12 to arrive to the show element 20 is in 34 seconds. The controller 46 may receive the show timer signal 52 indicating that the start time for the show element 20 is in 34 seconds. Thus the ride vehicle 12 will arrive at the show element 20 on time, and speed corrections to the ride vehicle 12 are not required. As such, the controller 46 is configured to output the disengage signal 62.

To facilitate these communications, the controller 46, the sensor 58, the show clock 22, the at least one support element 38, and the motion governor 26 may include communications circuitry 64, such as antennas, radio transceiver circuits, signal processing hardware and/or software (e.g., hardware or software filters, A/D converters, multiplexer amplifiers), or a combination thereof. The communications circuitry 64 may be configured to communicate over wired or wireless communication paths via IR wireless communication, satellite communication, broadcast radio, microwave radio, Bluetooth, Zigbee, Wifi, UHF, NFC, etc. Such communication may also include intermediate communications devices, such as radio towers, cell towers, etc.

Figure 3:
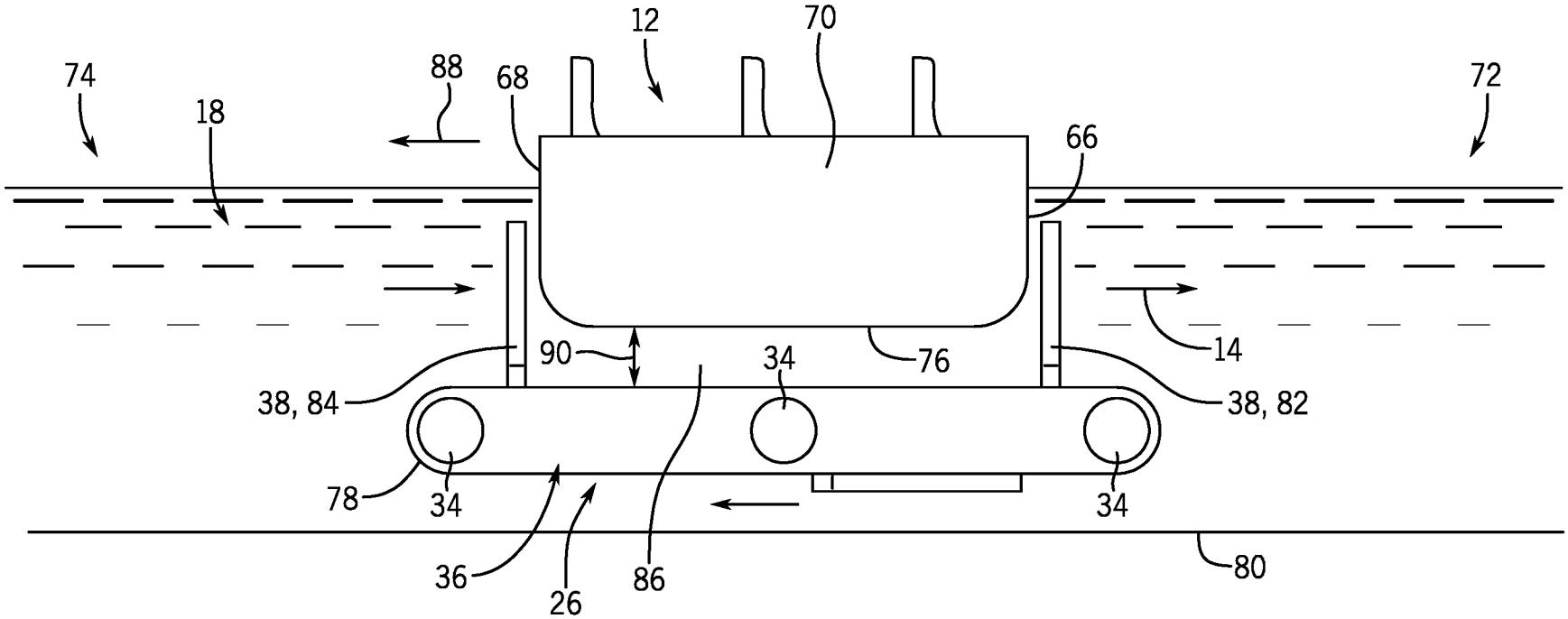
FIG. 3 is a side view of a motion governor and a ride vehicle, in accordance with present techniques.

FIG. 3 is a side view of the motion governor 26 and the ride vehicle 12. In some embodiments, the ride vehicle 12 has a designated front side 66, rear side 68, and lateral sides 70. However, in other embodiments, the front side 66, rear side 68, and lateral sides 70 merely designate an outer portion of the ride vehicle 12 with respect to the flow path 14. For example, some ride vehicles 12 may be substantially circular such that the ride vehicle 12 does not have an inherent front side 66. In such cases, the front side 66 of the ride vehicle 12 refers to a side of the ride vehicle 12 facing downstream 72 of the flow path 14 and oriented in the direction of travel of the flow path 14. Similarly, the rear side 68 refers to a portion of the ride vehicle 12 facing upstream 74 of the flow path 14, and the lateral sides 70 refer to portions of the ride vehicle 12 facing perpendicular to the front side 66 and the rear side 68 of the ride vehicle 12. Moreover, the ride vehicle 12 has a bottom portion 76.

In some embodiments, the motion governor 26 includes the at least one support element 38 configured to contact the ride vehicle 12 to control movement of the ride vehicle 12 along the flow path 14. The at least one support element 38 may be coupled to a conveyor 36 having a track 78 configured to rotate within the flow path 14. The conveyor 36 may be disposed proximate a bottom 80 of the flume 18 such that the ride vehicle 12 passes over the conveyor 36 as the ride vehicle 12 travels along the flow path 14. The driving mechanism 34 may be configured to rotate the conveyor 36 based at least in part on the control signal from the controller. In some embodiments, the driving mechanism 34 is configured to adjust a rate of actuation of the conveyor 36 based on the control signal. The controller may be configured to generate the control signal to actuate the driving mechanism 34 at a rate configured to slow down the ride vehicle 12 based at least in part on a determination that the ride vehicle 12 will arrive to the show element 20 before a start time of the show element 20. The at least one support element 38 may configured to contact a front side 66 of the ride vehicle 12 to decelerate movement of the ride vehicle 12. For example, the ride vehicle 12 may be moving along the flow path 14 at a rate such that the ride vehicle 12 will arrive at the show element 20 before the start time of the show element 20. As such, the controller generates a control signal to the driving mechanism 34, and in response to the control signal, the driving mechanism 34 rotates the conveyor 36 such that the at least one support element 38 moves along the flow path 14 at a rate slower than the ride vehicle 12. The front side 66 of the ride vehicle 12 may contact the at least one support element 38. The at least one support element 38 may slow the ride vehicle 12 to the rate of the at least one support element 38.

In another embodiment, the controller is configured to generate a control signal to actuate the driving mechanism 34 at a rate configured to speed up the ride vehicle 12 based at least in part on a determination that the ride vehicle 12 will arrive to the show element 20 after a start time of the show element 20. The at least one support element 38 may configured to contact the rear side 68 of the ride vehicle 12 to accelerate movement or maintain movement of the ride vehicle 12.

In some embodiments, the motion governor 26 includes a first support element 82 and a second support element 84. In some embodiments, the conveyor 36 may be configured to rotate such that the motion governor 26 receives the ride vehicle 12 in a slot 86 disposed between the first support element 82 and the second support element 84. The first support element 82 may positioned proximate the front side 66 of the ride vehicle 12 and the second support element 84 may be positioned proximate the rear side 68 of the ride vehicle 12. In some embodiments, the ride vehicle 12 is configured to decelerate in response to contact with the first support element 82, accelerate in response to contact with the second support element 84, and free float when not in contact with either the first support element 82 or the second support element 84. The support element or elements 38 are sized and shaped to come into contact with the ride vehicle 12 when deployed and in position.

The at least one support element 38 may not contact the bottom portion 76 of the ride vehicle 12 to maintain the floating or buoyant effect experienced by a guest in the ride vehicle 12. Each support element 38 may be configured to only restrict movement of the ride vehicle 12 along an axis or in a particular direction. For example, the at least one support element 38 may contact the rear side 68 of the ride vehicle 12 in response to a control signal having instructions to accelerate the ride vehicle 12, which restricts movement of the ride vehicle 12 in a rearward direction 88. The at least one support element 38 does not contact a bottom portion 76 of the ride vehicle 12. Therefore, the ride vehicle 12 maintains freedom of movement in a vertical direction 90. As such, the ride vehicle 12 may rise and fall with respective rising and falling of water in the flume 18. The rising and falling of the ride vehicle 12 with respect to the water in the flume 18 may maintain the floating or buoyant effect experienced by a guest in the ride vehicle 12.

Figure 4:
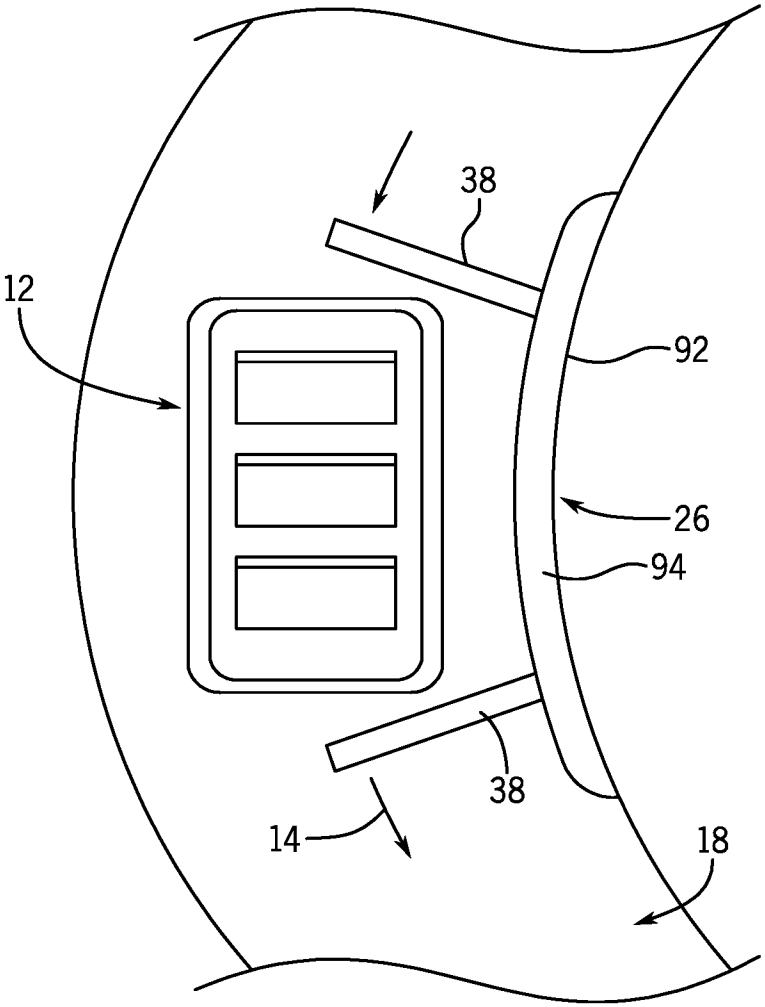
FIG. 4 is a top view of another embodiment of the motion governor and the ride vehicle, in accordance with present techniques.

In some embodiments, the controller is configured to output the control signal to the driving mechanism 34 to create a show effect. The show effect may simulate turbulent water or the ride vehicle crashing into an obstacle. For example, the ride vehicle 12 may enter a portion of the water-based attraction 10 configured to simulate white water rapids. The controller may output the control signal to the driving mechanism 34 such that the driving mechanism 34 drives the at least one support element 38 into the lateral side 70 of the ride vehicle 12. Contact between the ride vehicle 12 and the at least one support element 38 may jolt the ride vehicle 12 in the later direction 120 to simulate the ride vehicle 12 colliding with a rock. FIG. 4 is a top view of another embodiment of the motion governor 26 and the ride vehicle 12. In some embodiments, the motion governor 26 is disposed on a side wall 92 of the flume 18. The at least one support element 38 may extend laterally into the flow path 14 from the motion governor 26. In some embodiments, the at least one support element 38 is coupled to a slide track 94. The slide track 94 may be configured to move the at least one support element 38 in the direction of the flow path 14 to accelerate or decelerate the ride vehicle 12. Moreover, the driving mechanism 34 may be configured to drive the at least one support element 38 along the slide track 94 in response to the control signal from the controller. In some embodiments, the at least one support element 38 is coupled to a conveyor 36 disposed on the side wall 92 such that the at least one support element 38 is configured to move relative to the side wall 92 of the flume 18.

Figure 5:
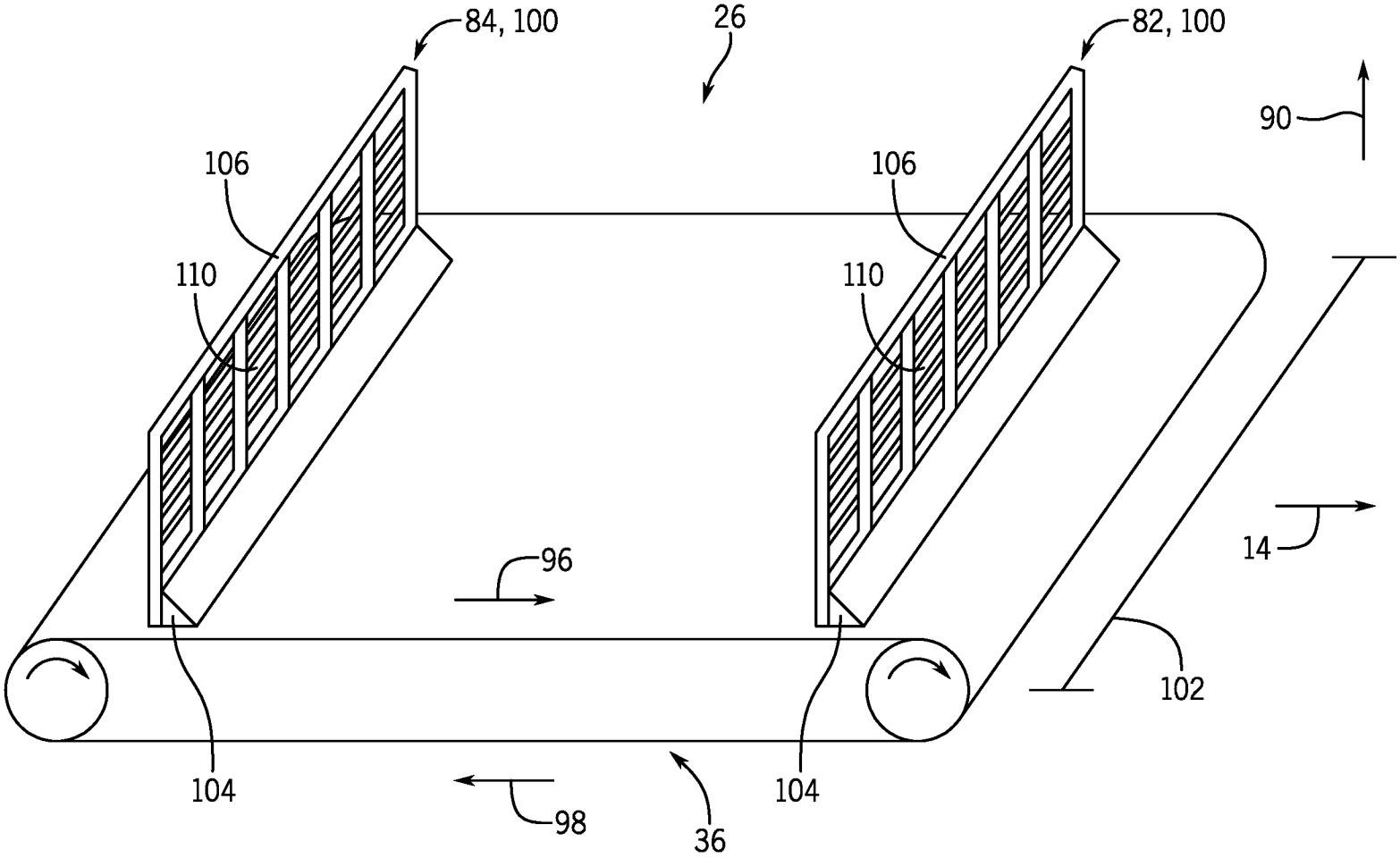
FIG. 5 is a perspective view of the motion governor having a plurality of support elements.

FIG. 5 is a perspective view of the motion governor 26 having the first support element 82 and the second support element 84. The first support element 82 may be disposed downstream 72 relative to the second support element 84. The conveyor 36 may be configured to move the first support element 82 and the second support element 84 in a downstream direction 96 to control movement of the ride vehicle 12. The downstream direction 96 may be the direction of the flow path 14 in the flume 18. The conveyor 36 may move the at least one support element 38 in an upstream direction 98 after the at least one support element 38 reaches a downstream end of the conveyor 36.

In some embodiments, the at least one support element 38 is a paddle 100 configured to contact the front side 66, rear side 68, or lateral side of the ride vehicle 12. The paddle 100 may extend along a width 102 of the conveyor 36. The width 102 of the conveyor 36 may be similar to a width of the ride vehicle 12. Moreover, the paddle 100 may be coupled to the conveyor 36 at a base 104 of the paddle 100. A free end 106 of the paddle 100 may extend out from the conveyor 36 in a direction toward a surface of the water in the flume 18 (e.g., the vertical direction 90) when the paddle 100 is moving in the downstream direction 96. However, the free end 106 of the paddle 100 may be submerged under the surface of the water in the flume 18 such that the paddle 100 may not be visible to a guest in the ride vehicle 12. The paddle 100 may have a grated form including through passages 110 such that fluid from the flow path 14 passes through at least one interior portion of the paddle 100. The grated form may reduce an amount of power required to move the paddle 100 along the flow path 14.

Figure 6:
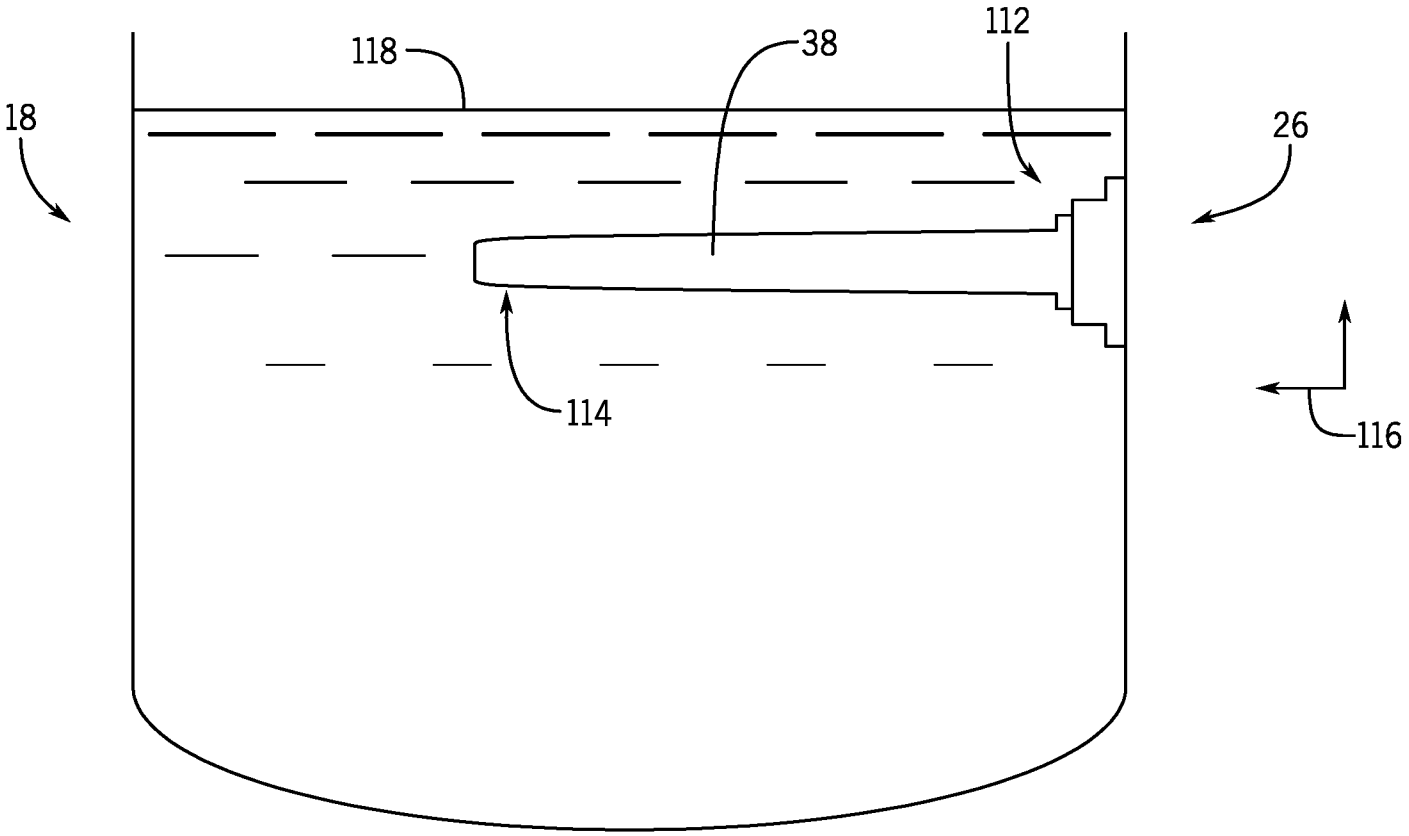
FIG. 6 is a front view of another embodiment of the motion governor having a support element.

FIG. 6 is a front view of another embodiment of the motion governor 26 having at least one support element 38. The at least one support element 38 may have a rod shape. Moreover, the at least one support element 38 may have a tapered rod shape. The at least one support element 38 may be coupled to the motion governor 26 at a base end 112. The tapered rod shape may have a decreasing diameter along a length of the at least one support element 38 such that a diameter at the base end 112 of the at least one support element 38 is greater than a diameter at a free end 114 of the at least one support element 38. In some embodiments, the free end 114 of the at least one support element 38 may extend out from the motion governor 26 in lateral direction. In some embodiments, the at least one support element 38 may extend out from the motion governor 26 in a horizontal direction 116. The at least one support element 38 may be submerged under the surface of the water 118 in the flume 18. However, in another embodiment, the at least one support element 38 may be fully or partially above the surface of the water 118 in the flume 18.

Figure 7:
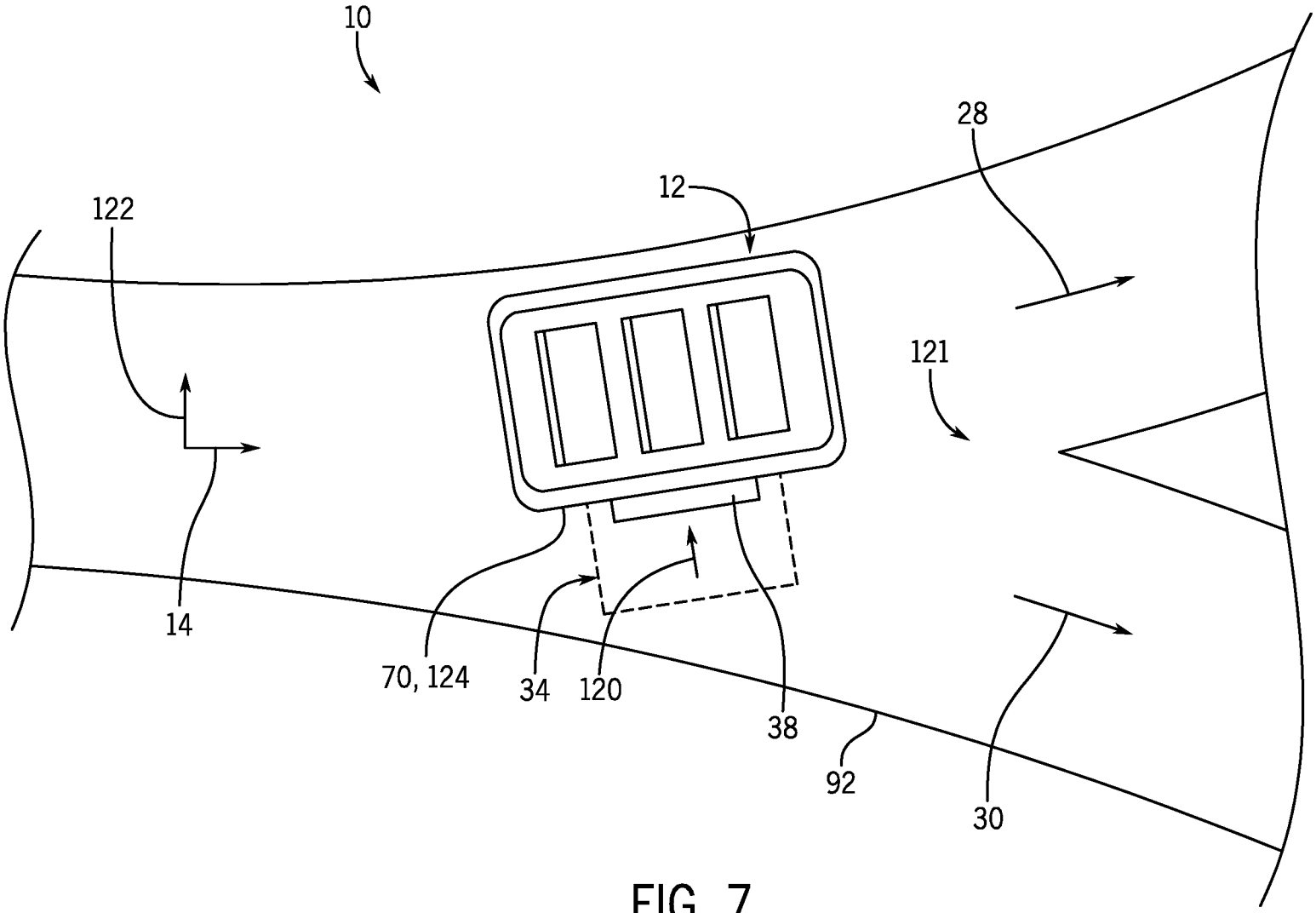
FIG. 7 is a top view of the water-based ride attraction having a switch track, in accordance with present techniques.

FIG. 7 is a top view of the water-based attraction 10 having a switch track and in which an orientation of the ride vehicle 12 may be altered using the disclosed techniques. In some embodiments, the driving mechanism 34 is configured to drive the at least one support element 38 in a lateral direction 120 with respect to the flow path 14. As such, the at least one support element 38 is configure to contact the lateral side 70 of the ride vehicle 12 to cause lateral movement of the ride vehicle 12. Moreover, the driving mechanism 34 may be oriented in a direction transverse to the flow path 122. In another embodiment, the flow path 14 may split into the first flow path 28 and the second flow path 30 at a divergence in the flow path 14. The controller may be configured to output the control signal to direct the ride vehicle 12 to the first flow path 28 or the second flow path 30. The driving mechanism 34 may be configured to receive the control signal and drive the at least one support element 38 based at least in part on the control signal. For example, the ride vehicle 12 may approach the divergence point 121 of the flow path 14. The controller may output the control signal having instructions for the driving mechanism 34 to direct the ride vehicle 12 left to the first flow path 28. The driving mechanism 34 may be configured to receive the control signal and drive the at least one support element 38 to the left with respect to the flow path 14. The at least one support element 38 may contact a right side 124 of the ride vehicle. The contact between the ride vehicle 12 and the at least one support element 38 may drive the ride vehicle 12 left to the first flow path 28. While the depicted embodiment shows lateral motion effects, it should be understood that the at least one support elements 38 may be configured to extend from one or more side walls 92 of the flume 18 to dynamically adjust an orientation of the ride vehicle 12.

Figure 8:
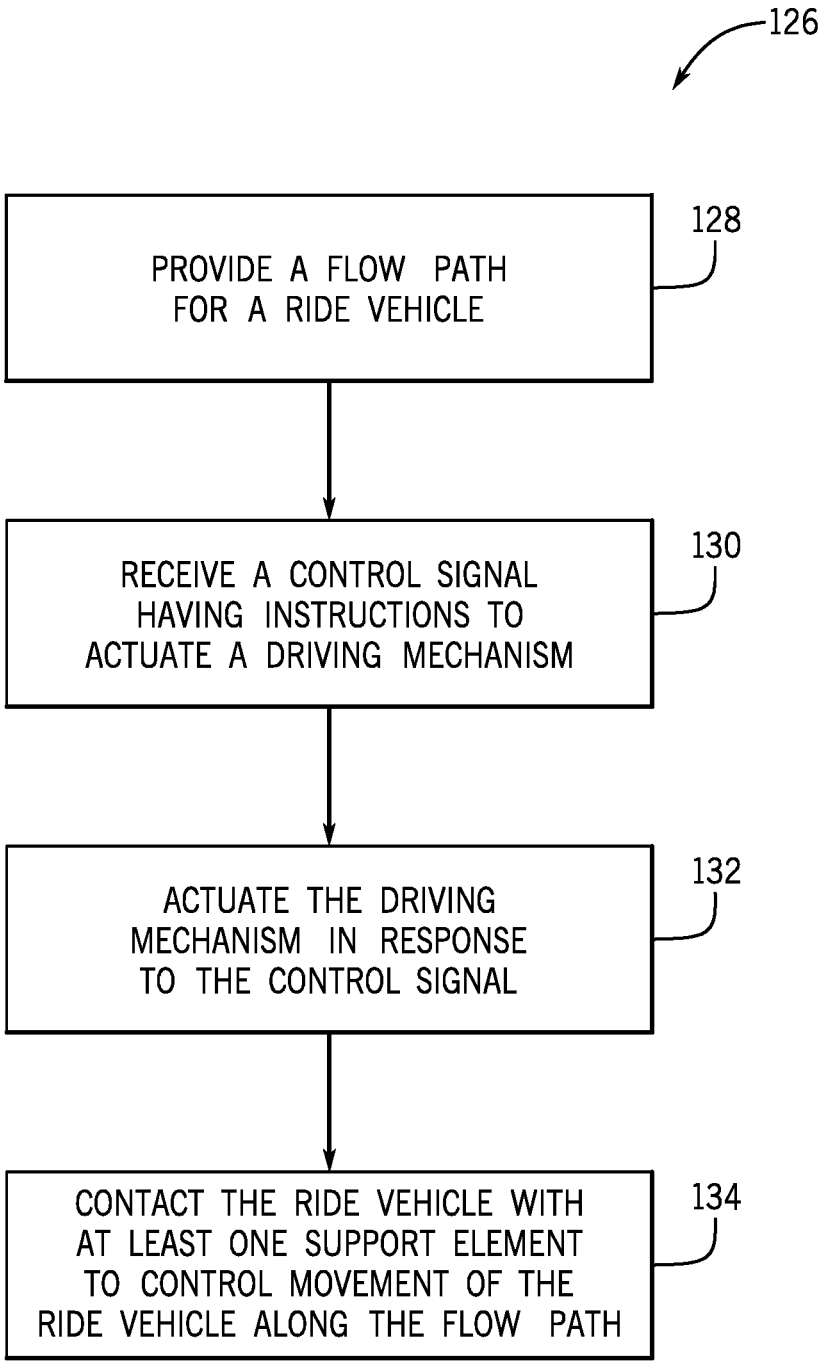
FIG. 8 is a flow diagram of a method to govern motion of the ride vehicle along a flow path of the water-based ride attraction, in accordance with present techniques.

FIG. 8 is a flow diagram 126 of a method to govern motion of the ride vehicle along the flow path of the water-based ride attraction. The method includes the step of providing a flow path for the ride vehicle 128. The water-based ride attraction has a water or fluid-filled flume that is configured to provide the flow path for the ride vehicle.

The method also includes the step of receiving the control signal having instructions to actuate the driving mechanism based at least in part on the location of a ride vehicle and the show timer for a show element 130. As set forth above, the controller is configured to determine an estimated arrival time of the ride vehicle to the show element. Further, the controller is configured to determine a rate for the driving mechanism to control movement of the ride vehicle such that the ride arrives at the show element at a start time of the show element based at least in part on the location of the ride vehicle and the show timer. The controller is configured to generate the control signal to actuate the driving mechanism at a rate configured to slow down the ride vehicle based at least in part on a determination that the ride vehicle will arrive to the show element before a start time of the show element. Moreover, the controller is configured to generate the control signal to actuate the driving mechanism at a rate configured to speed up the ride vehicle based at least in part on a determination that the ride vehicle will arrive to the show element after a start time of the show element. The control signal may be generated based on a determination that the ride vehicle will not arrive at a scheduled start time of the show element based on the location and/or speed of the ride vehicle.

The method also includes the step of actuating the driving mechanism in response to the control signal 132. The at least one support element may be coupled to the driving mechanism and configured to move together with the driving mechanism. The method includes the additional step of contacting the ride vehicle with the at least one support element to control movement of the ride vehicle along the flow path 134. The at least one support element may contact the ride vehicle at a front side, rear side, or lateral side at an instructed rate, based at least in part on the control signal, to control movement of the ride vehicle along the flow path.

While only certain features and embodiments have been illustrated and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, colors, orientations, etc.) without materially departing from the novel teachings and advantages of the disclosed subject matter. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A ride system, comprising:

a flume providing a flow path of a water ride and configured to accommodate a buoyant ride vehicle;

at least one support element extending into the flow path and at least partially submerged within the flow path;

a driving mechanism configured to actuate the at least one support element such that the at least one support element moves relative to the flow path in response to a control signal, wherein the at least one support element is configured to contact the buoyant ride vehicle to control movement of the buoyant ride vehicle along the flow path while the at least one support element is being actuated; and a controller configured to generate the control signal based at least in part on a location of the buoyant ride vehicle in the flow path and a timer controlling activation of a show element, wherein the show element is located along the flow path.

2. The ride system of claim 1, wherein the driving mechanism is configured to adjust a rate of actuation of the at least one support element based on the control signal.

3. The ride system of claim 1, wherein the driving mechanism is configured to rotate a conveyor, the conveyor disposed within the flow path, and wherein the at least one support element is coupled to the conveyor and configured to move in conjunction with rotation of the conveyor.

4. The ride system of claim 1, wherein the driving mechanism is configured to drive the at least one support element along a slide track in response to the control signal.

5. The ride system of claim 1, wherein the at least one support element is configured to contact a rear side of the buoyant ride vehicle to accelerate movement or maintain movement of the buoyant ride vehicle.

6. The ride system of claim 1, wherein the at least one support element is configured to contact a front side of the buoyant ride vehicle to decelerate movement of the buoyant ride vehicle.

7. The ride system of claim 1, wherein the at least one support element is configured to contact a lateral side of the buoyant ride vehicle to cause lateral movement of the buoyant ride vehicle.

8. The ride system of claim 1, wherein the flow path separates into a first flow path and a second flow path at a divergence point, and wherein the at least one support element is configured to move the buoyant ride vehicle toward the first flow path or the second flow path at the divergence point based at least in part on the control signal.

9. The ride system of claim 1, further comprising a sensor configured to detect the location of the buoyant ride vehicle in the flow path and output a location signal indicative of a distance between the buoyant ride vehicle and the show element.

10. The ride system of claim 9, wherein the controller is configured to receive the location signal indicative of the location of the buoyant ride vehicle in the flow path and determine a speed of the buoyant ride vehicle and an estimated arrival time of the buoyant ride vehicle to the show element based at least in part on the location signal.

11. The ride system of claim 1, wherein the at least one support element comprises a paddle configured to reversibly contact a front, rear, or lateral side of the buoyant ride vehicle or a combination thereof.

12. The ride system of claim 11, wherein the paddle comprises a plurality of through passages such that fluid from the flow path passes through at least one interior portion of the paddle.

13. The ride system of claim 1, wherein the at least one support element is configured to be retracted or positioned out of the flow path in a default position and wherein the control signal causes deployment of the at least one support element into the flow path in an activated position.

14. The ride system of claim 1, wherein the at least one support element comprises a first support element and a second support element, wherein the first support element is positioned proximate a front side of the buoyant ride vehicle and the second support element is positioned proximate a rear side of the buoyant ride vehicle, and wherein the buoyant ride vehicle is configured to decelerate in response to contact with the first support element, accelerate in response to contact with the second support element, and free float when disposed between the first support element and the second support element.

15. The ride system of claim 1, wherein the controller generates the control signal to control rotation of a conveyor based on the location of the buoyant ride vehicle and a conveyor location such that rotation of the conveyor moves the at least one support element towards the buoyant ride vehicle.

16. The ride system of claim 15, wherein the control signal causes the conveyor to move the at least one support element along an axis of travel of the buoyant ride vehicle in the flow path.

17. The ride system of claim 15, wherein the conveyor is coupled to a side wall of the flume.

18. The ride system of claim 15, wherein the conveyor is submerged within the flow path.

19. The ride system of claim 1, wherein the at least one support element comprises a rod.

20. The ride system of claim 1, wherein the at least one support element is not fixed to the buoyant ride vehicle.

* * * * *